US005560277A

United States Patent [19]

Nomura et al.

[11] Patent Number: 5,560,277

[45] Date of Patent: Oct. 1, 1996

[54] STRUCTURE FOR ADJUSTING SWASH PLATE ANGLE OF A VARIABLE DISPLACEMENT HYDRAULIC MOTOR

[75] Inventors: Tomoyuki Nomura; Manabu Yamanishi; Syunryou Hayashida; Akira Tsuda; Tetsuo Ishioka; Hiroya Hanano, all of Sakai, Japan

[73] Assignee: Kubota Corporation, Osaka, Japan

[21] Appl. No.: 224,646

[22] Filed: Apr. 7, 1994

[30] Foreign Application Priority Data

| | | | |
|---|---|---|---|
| Aug. 11, 1993 | [JP] | Japan | 5-199542 |
| Aug. 11, 1993 | [JP] | Japan | 5-199543 |
| Aug. 11, 1993 | [JP] | Japan | 5-199544 |

[51] Int. Cl.[6] ..... F01B 3/02

[52] U.S. Cl. ..... 91/505; 92/12.2

[58] Field of Search ..... 91/505; 92/12.2; 417/269, 222.1, 222.2

[56] References Cited

U.S. PATENT DOCUMENTS

| | | | |
|---|---|---|---|
| 2,870,746 | 1/1959 | Keel . | |
| 3,009,422 | 11/1961 | Davis . | |
| 3,070,031 | 12/1962 | Puryear . | |
| 3,199,461 | 8/1965 | Wolf . | |
| 3,319,419 | 5/1967 | Hann . | |
| 3,665,814 | 5/1972 | Ankeny . | |
| 3,722,370 | 3/1973 | Aplin . | |
| 3,747,476 | 7/1973 | Ankeny . | |
| 4,168,653 | 9/1979 | Hein et al. | 92/12.2 |
| 4,212,596 | 7/1980 | Ruseff . | |
| 4,478,136 | 10/1984 | Heiser et al. | 417/222.1 |
| 4,690,036 | 9/1987 | Kosaka . | |
| 5,222,870 | 6/1993 | Budzich | 417/222.1 |
| 5,251,536 | 10/1993 | Engel . | |

FOREIGN PATENT DOCUMENTS

| | | |
|---|---|---|
| 0233484A2 | 8/1987 | European Pat. Off. . |
| 1242037 | 4/1960 | France . |
| 1296106 | 5/1962 | France . |
| 2612270 | 9/1977 | Germany . |
| 3221682 | 12/1983 | Germany . |
| 3520340 | 12/1985 | Germany . |
| 3911128 | 10/1990 | Germany . |
| 4300979 | 7/1993 | Germany . |
| 970584 | 10/1964 | United Kingdom . |
| 998577 | 7/1965 | United Kingdom . |
| 1220727 | 1/1971 | United Kingdom . |
| 1433024 | 4/1976 | United Kingdom . |

*Primary Examiner*—Timothy S. Thorpe
*Assistant Examiner*—William Wicker
*Attorney, Agent, or Firm*—Townsend and Townsend and Crew LLP

[57] ABSTRACT

A variable displacement hydraulic motor having a swash plate angle adjusting structure. This hydraulic motor has a main case, a rotary shaft rotatably supported in the main case, a plurality of cylinder blocks rotatable with the rotary shaft and including axial plungers, a swash plate member for contacting distal ends of the plungers, pivot shafts for pivotally connecting the swash plate member to the main case such that the swash plate member has a pivoting angle adjustable relative to the main case, and a first and a second hydraulic cylinders arranged at opposite sides of the pivot shafts as seen in a direction parallel to the rotary shaft. The first and second hydraulic cylinders are secured in a region of the main case opposed to the cylinder blocks across the swash plate member. The hydraulic cylinders are operable to contact the swash plate member to adjust the pivoting angle thereof.

11 Claims, 6 Drawing Sheets

Prior Art

STRUCTURE FOR ADJUSTING SWASH PLATE ANGLE OF A VARIABLE DISPLACEMENT HYDRAULIC MOTOR

BACKGROUND OF THE INVENTION

FIELD OF THE INVENTION

The present invention relates to a structure for adjusting swash plate angle of a variable displacement hydraulic motor for use in driving a crawler running device, for example.

DESCRIPTION OF THE RELATED ART

A variable displacement hydraulic motor includes a cylinder block having a plurality of axial plungers and rotatably mounted in a drive chamber defined in a main case. A swash plate is mounted in a deep inward region of the drive chamber to be contactable with forward ends of the plungers. The swash plate is tiltably supported by the main case which includes a hydraulic cylinder for pressing the swash plate at a side facing away from the plungers to tilt the swash plate. In a structure for varying angles of the swash plate, as shown in FIG. 7A, for example, a main case I includes spherical elements 30 (provided in pair and arranged in a direction perpendicular to the plane of FIG. 7A) on a deep end wall of a drive chamber D for engaging and supporting a swash plate 9 to be tiltable about a fixed axis. The main case 1 further includes a hydraulic cylinder 31 for pressing the swash plate 9 at a side facing away from the plungers to tilt the swash plate 9.

In this swash plate angle adjusting structure, the swash plate 9 is engaged and supported only by the spherical elements 30 in the deep end of the drive chamber D. No means is provided to inhibit the swash plate 9 from lifting or becoming loose toward a cylinder block 7. When the plungers 6 of the cylinder block 7 exert a smaller pressing force than the swash plate angle varying hydraulic cylinder 31, the swash plate 9 could become loose on the spherical elements 30, thereby to be tiltable in an unsteady way. To avoid such an inconvenience in practice, the axis Y of tilting of the swash plate 9 is offset from a motor axis X so that, based on the pressing force of the plungers 6 of the cylinder block 7, a tilting moment A is constantly applied to the swash plate 9 in a fixed direction (toward a low speed position).

However, in the mode in which the axis Y of tilting of the swash plate 9 is offset from the motor axis X to prevent the swash plate 9 from becoming loose, the hydraulic cylinder 31 must apply a strong pressing force to the swash plate 9 against the tilting moment A applied in the direction toward the low speed position, in order to vary the swash plate angle for a high speed condition, as shown in FIG. 7B. This requires the hydraulic cylinder 31 to have a large diameter, thereby making it difficult to achieve a compact motor. In addition, complicated setting of hydraulic circuitry is required, such as for suitably balancing the plunger pressing force and hydraulic cylinder pressing force, in order to stabilize postures of the swash plate 9. To meet his requirement, the components must have a high degree of precision, which has been a cause of the high manufacturing cost.

SUMMARY OF THE INVENTION

The present invention has been made having regard to the state of the an noted above, and its primary object is to provide a swash plate angle adjusting structure for a variable displacement hydraulic motor, which requires only a small hydraulic cylinder for varying a swash plate angle, and has a high practical utility effective to reduce manufacturing cost.

The above object is fulfilled, according to the present invention, by a variable displacement hydraulic motor comprising a main case, a rotary shaft rotatably supported in the main case, a plurality of cylinder blocks rotatable with the rotary shaft and including axial plungers, a swash plate member for contacting distal ends of the plungers, pivot shafts for pivotally connecting the swash plate member to the main case such that the swash plate member has a pivoting angle adjustable relative to the main case, and a first and a second hydraulic cylinders arranged at opposite sides of the pivot shafts as seen in a direction parallel to the rotary shaft, the hydraulic cylinders being secured in a region of the main case opposed to the cylinder blocks across the swash plate member, and operable to contact the swash plate member to adjust the pivoting angle.

In the above construction, the swash plate member is supported by the main case through a shaft structure which does not permit the swash plate member to become loose. It is therefore unnecessary to limit the pressing force of the hydraulic cylinders for avoiding the swash plate member becoming loose.

Consequently, the present invention offers the following advantages:

a) The swash plate tilting hydraulic cylinders may have a reduced diameter since a small pressing force is adequate for tilting purposes. This feature is effective to reduce the size and weight of the entire motor.

b) The present invention requires no complicated setting of hydraulic circuitry, such as for suitably balancing the plunger pressing force and hydraulic cylinder pressing force, in order to stabilize postures of the swash plate. This feature avoids cost increases due to the introduction of high precision components and quality control for achieving such setting.

c) No measure is required for the hydraulic circuitry to avoid loosening of the swash plate. Thus, the hydraulic circuitry may be designed with increased freedom.

Further and other objects, features and effects of the invention will become more apparent from the following more detailed description of an embodiment of the invention taken with reference to the accompanying drawings.

BRIEF DESCRIPTION OF THE DRAWINGS

FIGS. 7A and 7B are views showing a swash plate control structure for a hydraulic motor according to the prior art, in which FIG. 7A is a view showing the motor in a low speed position, and FIG. 7B is a view showing the motor in a high speed position.

DETAILED DESCRIPTION OF THE PREFERRED EMBODIMENT

Figure 1:
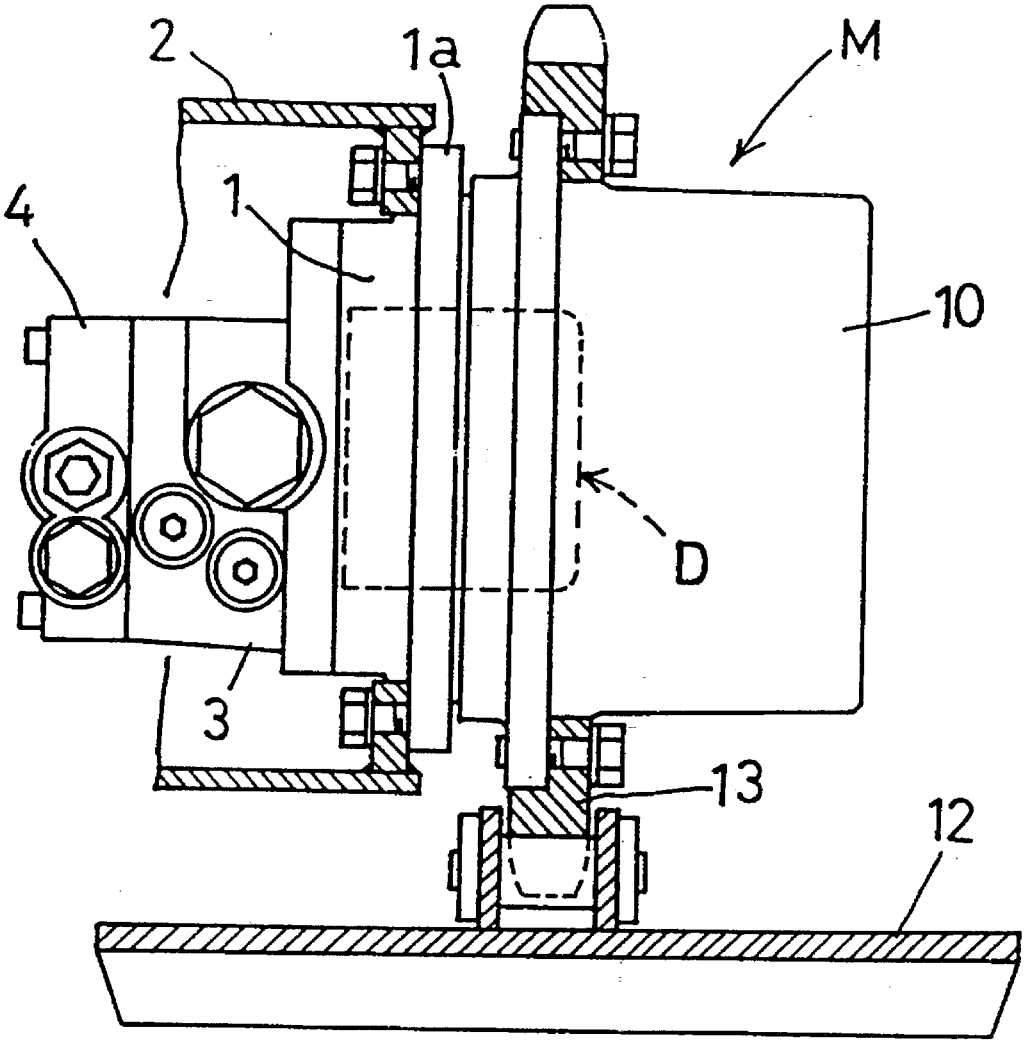
FIG. 1 is a view of a hydraulic motor according to the present invention as attached to a running device.
Figure 2:
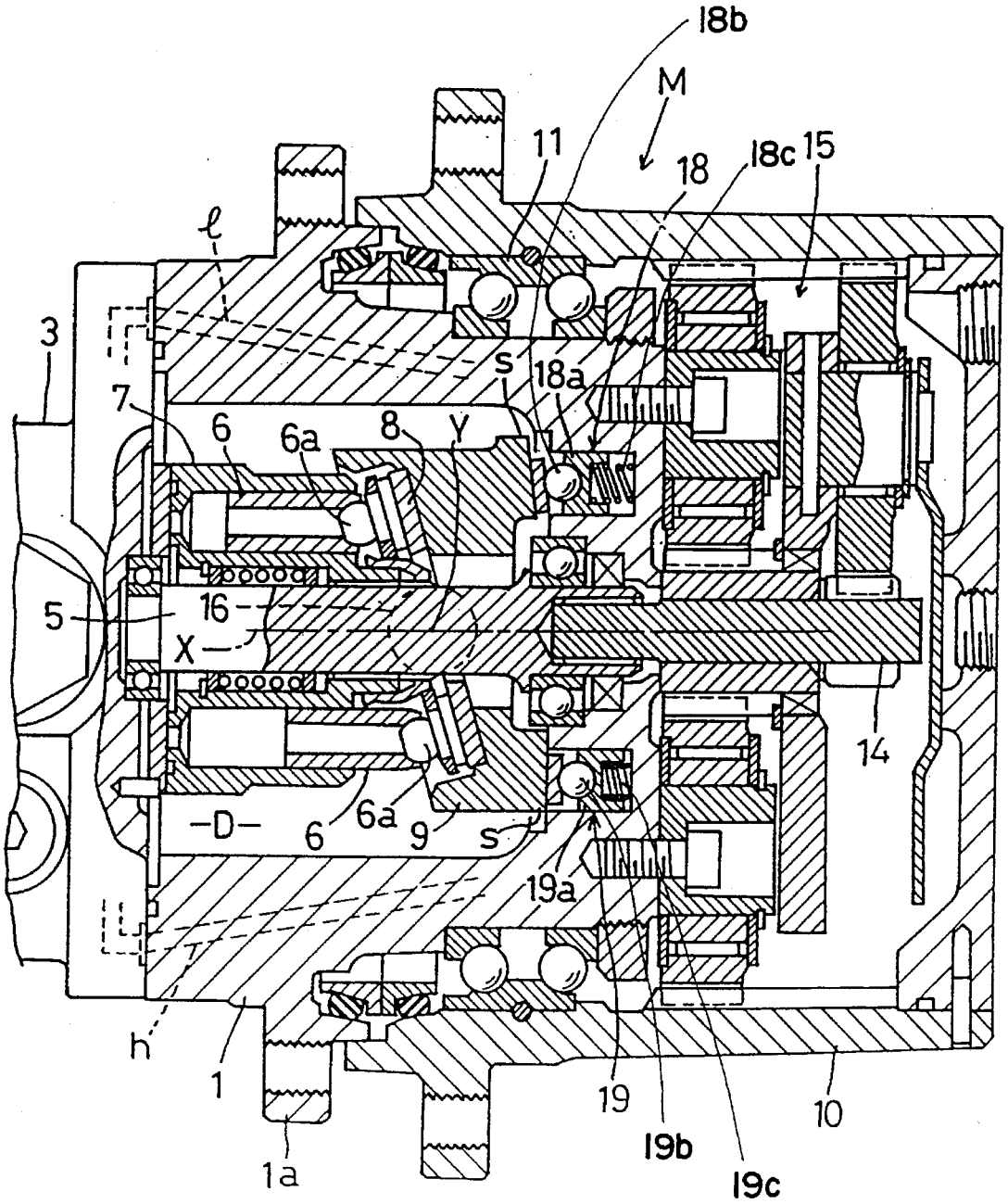
FIG. 2 is a sectional view taken through a rotational axis of the hydraulic motor of FIG. 1, showing a low speed position of the hydraulic motor.

FIG. 1 shows a variable displacement hydraulic motor M according to the present invention, as employed as a drive motor switchable between high speed and low speed for driving a crawler running device of a construction machine such as a backhoe. FIG. 2 shows a section of the hydraulic motor M.

The hydraulic motor M includes a main case 1 rigidly connected to a lateral wall of a chassis frame (track frame) 2 through a flange 1*a*, with a drive chamber D having an opening end closed by two hydraulic blocks 3 and 4 in series connection. A rotary shaft 5 extends horizontally and centrally of the drive chamber D. The rotary shaft 5 supports cylinder blocks 7 having a plurality of axial plungers 6 arranged peripherally thereof. A swash plate 9 is mounted in an inward end of the drive chamber D for receiving revolving heads 6*a* of the plungers 6 through a thrust plate 8.

A rotary case 10 is rotatably mounted on a front portion of the main case 1 through bearings 11. The rotary case 10 carries a drive sprocket 13 engaged with a crawler belt 12. As seen from FIG. 2, the rotary case 10 partly overlaps the main case 1. An output shaft 14 is mounted centrally of a front wall of the main case 1 and connected coaxially to the rotary shaft 5. The output shaft 14 is operatively connected to the rotary case 10 through a planetary gear reduction mechanism 15 mounted in the rotary case 10.

Figure 4:
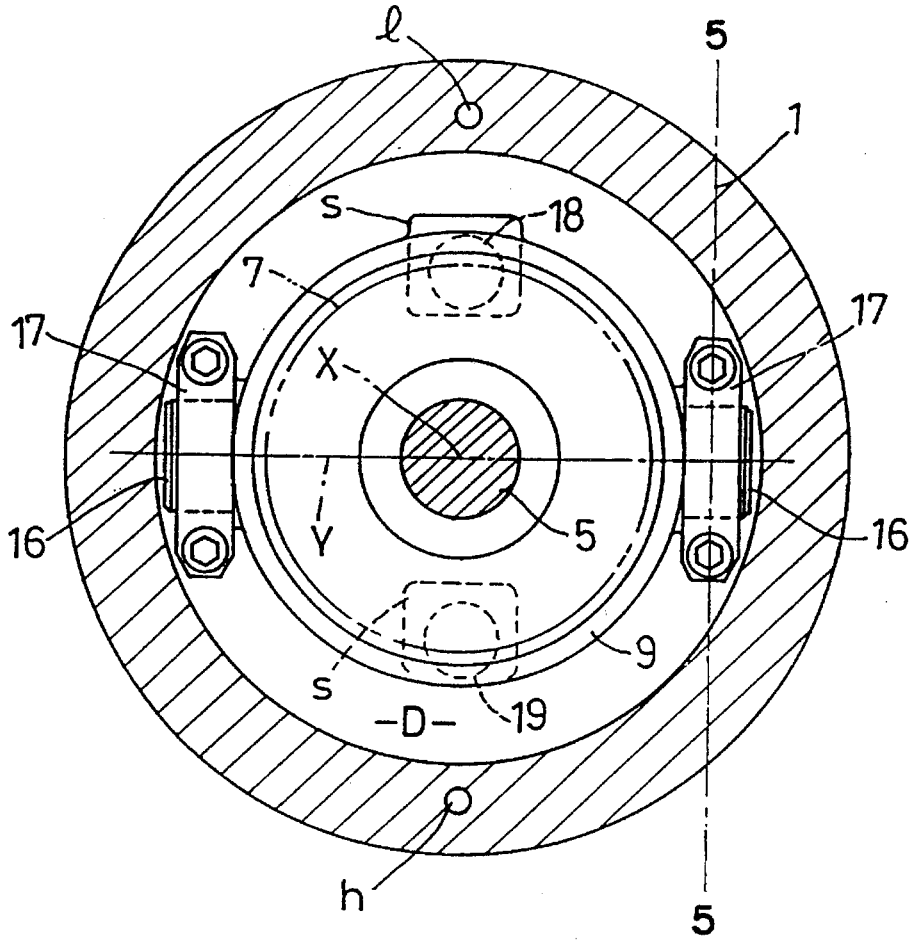
FIG. 4 is a front view of the hydraulic motor as seen in a direction along the rotational axis thereof, showing a swash plate supporting portion.
Figure 5:
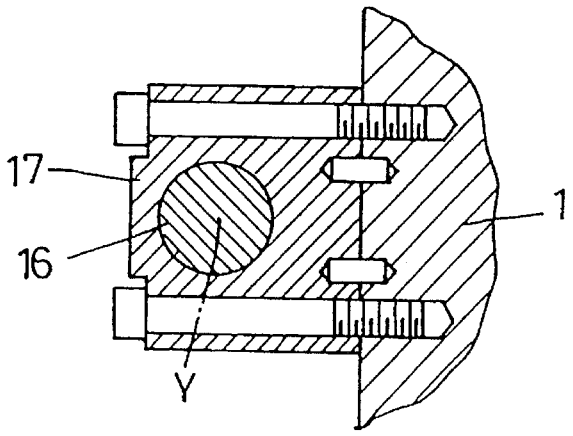
FIG. 5 is a fragmentary section taken on line A—A' of FIG. 4.

As shown in FIGS. 4 and 5, the swash plate 9 includes a pair of trunnions 16 projecting from diametrically opposite peripheral positions thereof. The trunnions 16 have an axis Y intersecting a motor axis X substantially at right angles thereto centrally of a pressure receiving plane of the swash plate 9. The trunnions 16 are rotatably fitted and supported in a pair of supporting brackets, specifically bearing blocks 17, removably bolted to inward walls of the drive chamber D opposed to the cylinder blocks across from swash plate 9.

The main case 1 further includes a pair of first and second hydraulic cylinders 18 and 19 arranged symmetrically about the axis Y of the trunnions 16 for varying swash plate angles, and oil passages "1" and "h" leading to the hydraulic cylinders 18 and 19. As shown in FIG. 2, the first and second hydraulic cylinders 18 and 19 are secured to a region of the main case 1 opposed to the plurality of cylinder blocks across the swash plate 9. The first cylinder 18 includes a ball 18*b* for contacting the swash plate 9, a plunger 18*a* for pushing the ball 18*b*, and a biasing spring 18*c* for biasing the plunger 18*a* toward the swash plate 9. The second cylinder 19 includes similar elements.

Figure 3:
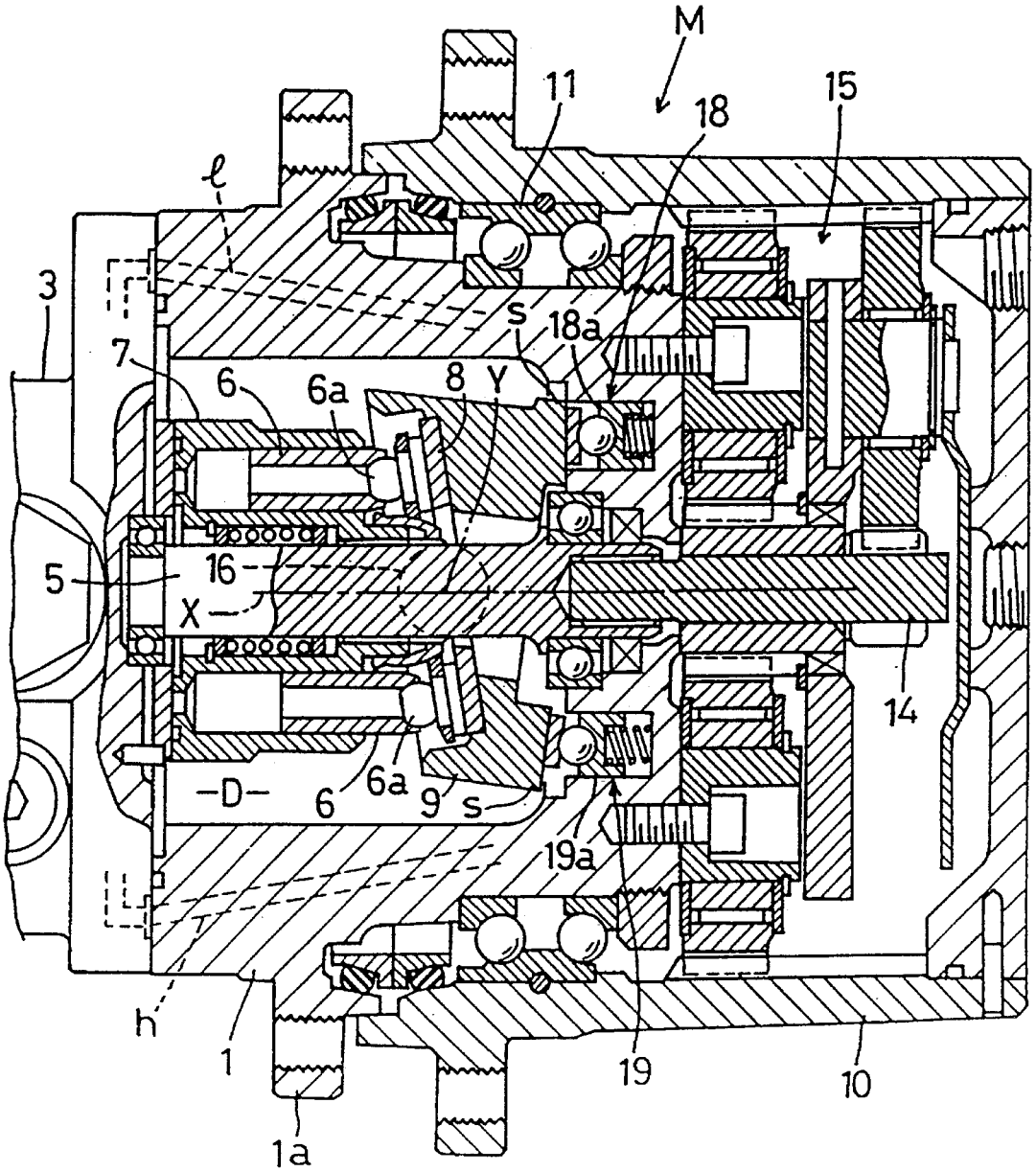
FIG. 3 is a sectional view taken through the rotational axis of the hydraulic motor of FIG. 1, showing a high speed position of the hydraulic motor.

The first and second hydraulic cylinders 18 and 19 are displaceable substantially parallel to the rotary shaft 5. When pressure oil is supplied only to the hydraulic cylinder 18 to extend its plunger 18*a*, the swash plate 9 produces a large tilt angle for a low speed condition as shown in FIG. 2. Conversely, when pressure oil is supplied only to the hydraulic cylinder 19 to extend its plunger 19*a*, the swash plate 9 produces a small tilt angle for a high speed condition as shown in FIG. 3.

The swash plate 9 has seats "s" having a relatively small area and elevated from rear surfaces thereof for contacting inward end surfaces of the drive chamber D to determine tilt angles of the swash plate 9.

According to the above construction, when the swash plate 9 requires to be disassembled for maintenance, the hydraulic blocks 3 and 4 are removed inwardly of the frame 2 to open the drive chamber D. Then, the cylinder blocks 7 are withdrawn from the rotary shaft 5 to expose the swash plate 9. The bolts fixing the pair of bearing blocks 17 in place are loosened. The swash plate 9 may now be drawn out of the drive chamber D along with the bearing blocks 17.

Figure 6:
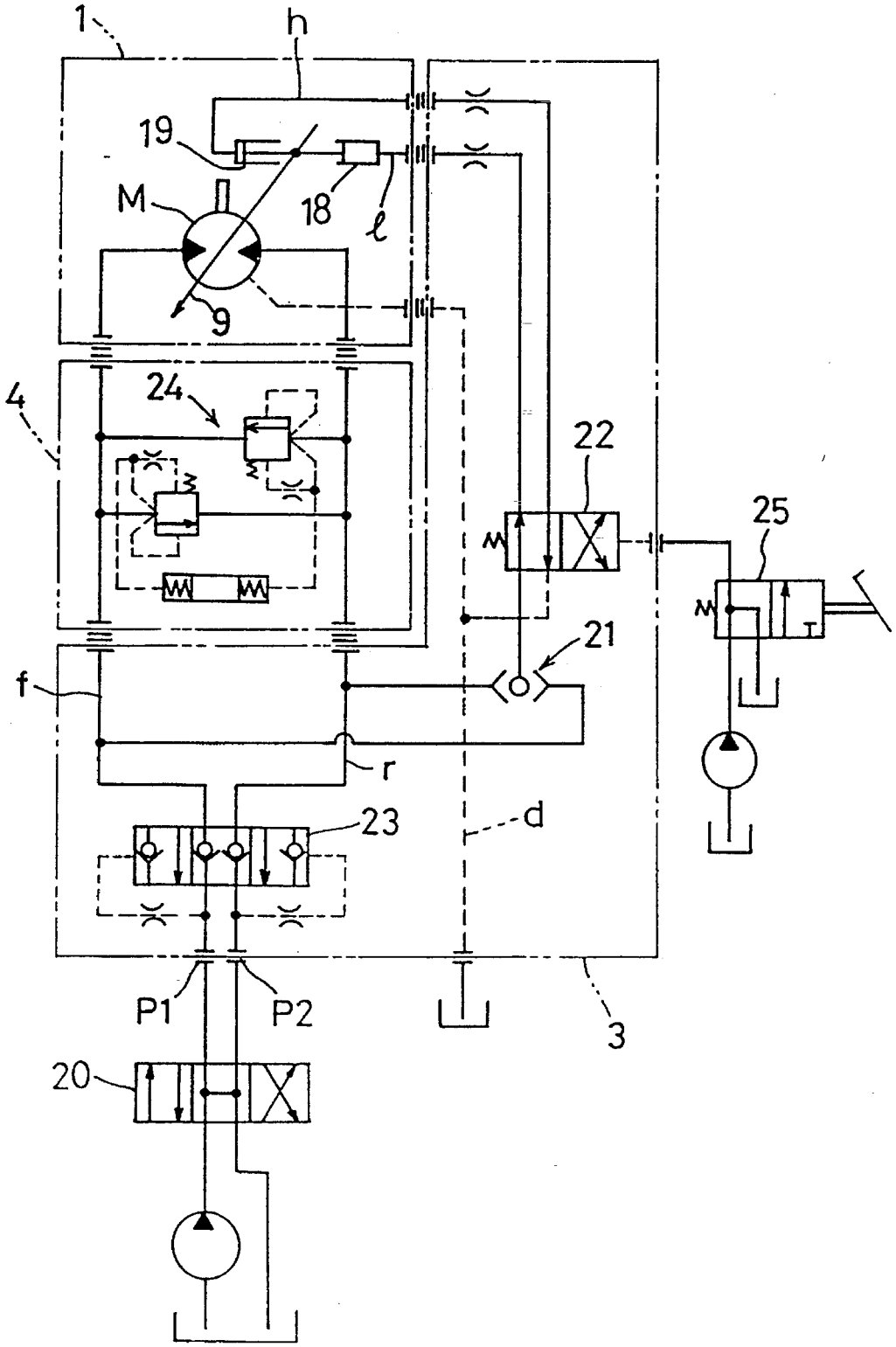
FIG. 6 is a diagram of hydraulic circuitry relating to the hydraulic motor according to the present invention.
Figure 7A:
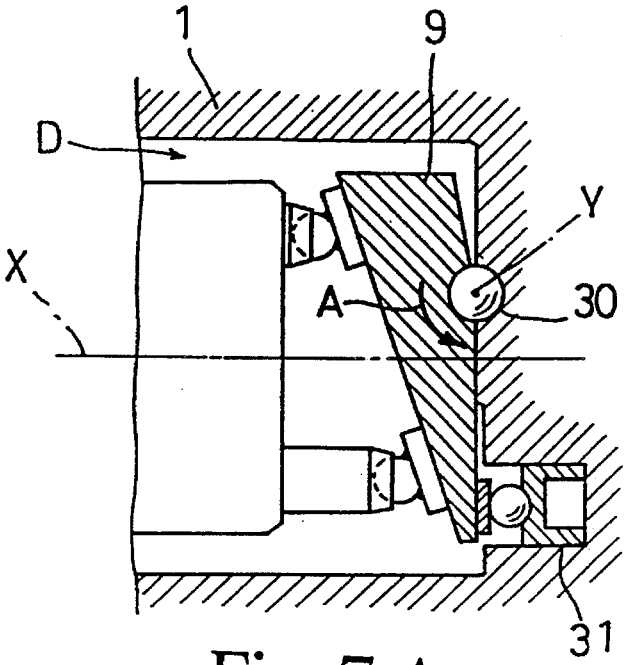
Figure 7B:
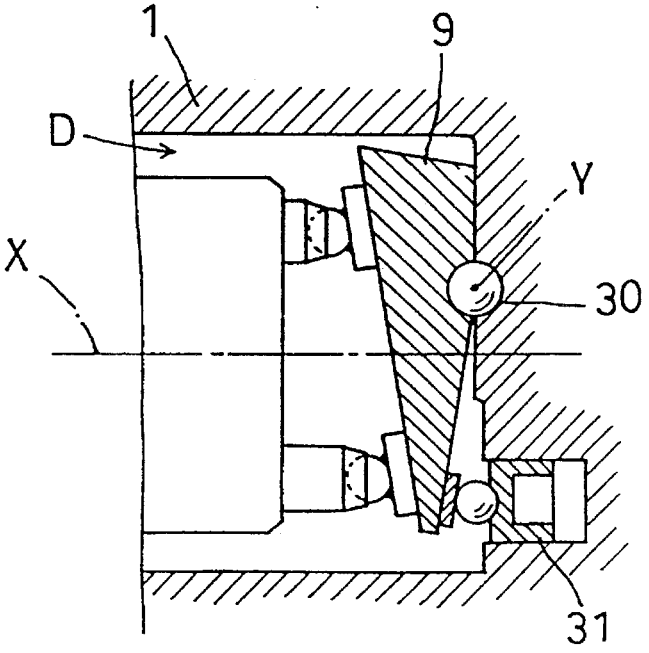

FIG. 6 shows hydraulic circuitry for driving the hydraulic motor M.

In FIG. 6, numeral 20 denotes a propelling control valve switchable mechanically or by a hydraulic pilot system in response to operation of a control lever, not shown, to selectively supply pressure oil to a port P1 or P2 to rotate the hydraulic motor M forward or backward. Numeral 21 denotes a high pressure selecting shuttle valve connected to a forward drive oil line "f" and a reverse oil line "r". The shuttle valve 21 supplies selected forward or backward drive pressure oil to the swash plate angle varying hydraulic cylinder 18 or 19. Numeral 22 denotes a hydraulic pilot type line selector valve disposed between the shuttle valve 21 and hydraulic cylinder 18 and 19. In a normal state free from pilot pressure, as shown in FIG. 6, the selector valve 22 supplies pressure oil from the shuttle valve 21 to the oil line "1" leading to the hydraulic cylinder 18, and communicates the oil line "h" leading to the other hydraulic cylinder 19 with a drain oil line "d". Upon application of the pilot pressure, the selector valve 22 supplies the pressure oil from the shuttle valve 21 to the oil line "h" leading to the hydraulic cylinder 19, and communicates the oil line "1" leading to the other hydraulic cylinder 18 with the drain oil line "d".

The shuttle valve 21, line selector valve 22 and a counterbalance valve 23 are incorporated into the hydraulic block 3, while a shockless mechanism 24 is incorporated into the hydraulic block 4.

Normally, the line selector valve 22 is free from the pilot valve, and the pressure oil is supplied only to the hydraulic cylinder 18 for low speed, with the swash plate 9 pressed to a low speed position as shown in FIG. 2. When the pilot valve 24 is switched by a pedal operation to apply the pilot pressure to the line selector valve 22, the selector valve 22 is switched to supply the pressure oil only to the hydraulic cylinder 19 for high speed. Then, as shown in FIG. 3, the swash plate 9 is tilted to and retained in a high speed position.

What is claimed is:

1. A hydraulic motor comprising:

a main case;

a rotary shaft rotatably supported in said main case;

a plurality of cylinder blocks rotatable with said rotary shaft and including axial plungers;

a swash plate member for contacting distal ends of said plungers;

pivot shafts for pivotally connecting said swash plate member to said main case such that said swash plate member has a pivoting angle adjustable relative to said main case;

first and second hydraulic cylinders arranged at opposite sides of said pivot shafts as seen in a direction parallel to said rotary shaft, said hydraulic cylinders being secured in a region of said main case opposed to said cylinder blocks across said swash plate member, and operable to contact said swash plate member to adjust said pivoting angle; and supporting brackets, fixed to said main case at positions in said region opposed to said cylinder blocks across from said swash plate member, to which said pivot shafts are pivotally mounted.

2. A hydraulic motor as defined in claim 1, further comprising a pair of motor driving oil lines, a shuttle valve connected to said oil lines, and a line selector valve disposed between said first and second hydraulic cylinders and said shuttle valve, wherein said line selector valve is operable to supply motor driving oil pressure to only one of said first and second hydraulic cylinders to adjust said pivoting angle of said swash plate member.

3. A hydraulic motor as defined in claim 1, wherein said first and second hydraulic cylinders are displaceable substantially parallel to said rotary shaft.

4. A hydraulic motor as defined in claim 1, wherein each of said first and second hydraulic cylinders includes a ball for contacting said swash plate member, a plunger for pushing said ball, and a biasing spring for biasing said plunger toward said swash plate member.

5. A hydraulic motor as defined in claim 1, wherein said swash plate member includes a thrust plate and a support element for supporting said thrust plate.

6. A hydraulic motor as defined in claim 1, wherein said pivot shafts have an axis extending substantially perpendicular to an axis of said rotary shaft.

7. A hydraulic motor as defined in claim 1, further comprising a rotary case connected to said rotary shaft through planetary gearing.

8. A hydraulic motor as defined in claim 7, wherein said rotary case partly overlaps said main case, with bearings interposed between said main case and said rotary case for allowing relative rotation therebetween.

9. A hydraulic motor as defined in claim 1, wherein all of said cylinder blocks are arranged substantially equidistantly from an axis of said rotary shaft.

10. A hydraulic motor as defined in claim 9, wherein said pivot shafts are arranged in positions substantially intersecting said axis of said rotary shaft.

11. A hydraulic motor as defined in claim 10, wherein said first hydraulic cylinder is operable to tilt said swash plate member in one direction, while said second hydraulic cylinder is operable to tilt said swash plate member in the other direction, both about said pivot shafts.

* * * * *